United States Patent [19]

Hirai et al.

[11] Patent Number: 4,511,650

[45] Date of Patent: Apr. 16, 1985

[54] HEAT DEVELOPABLE COLOR LIGHT-SENSITIVE MATERIALS WITH BASE RELEASORS

[75] Inventors: Hiroyuki Hirai; Ken Kawata, both of Kanagawa, Japan

[73] Assignee: Fuji Photo Film Co., Ltd., Kanagawa, Japan

[21] Appl. No.: 590,396

[22] Filed: Mar. 16, 1984

[30] Foreign Application Priority Data

Mar. 16, 1983 [JP] Japan ..... 58-43860

[51] Int. Cl.[3] ..... G03C 5/54; G03C 1/40

[52] U.S. Cl. ..... 430/559; 430/203; 430/617; 430/619; 430/955

[58] Field of Search ..... 430/203, 351, 353, 617, 430/619, 955, 559

[56] References Cited

U.S. PATENT DOCUMENTS

| | | | |
|---|---|---|---|
| 3,220,846 | 11/1965 | Tinker et al. | 430/346 |
| 4,088,496 | 5/1978 | Merkel | 430/635 |
| 4,463,079 | 7/1974 | Naito et al. | 430/351 |

*Primary Examiner*—Richard L. Schilling

*Attorney, Agent, or Firm*—Sughrue, Mion, Zinn, Macpeak & Seas

[57] ABSTRACT

A heat developable color light-sensitive material is disclosed. The material is comprised of a support base having thereon a light-sensitive silver halide, a binder, a dye-releasing material and a base precursor. The dye-releasing material is reductive to the light-sensitive silver halide and releases hydrophilic dye by causing a reaction with the light-sensitive silver halide by heating. The base precursor is a compound represented by the general formulae (A) and/or (B):

(A)

(B)

wherein the substituents are defined within the specification. The material is capable of forming images by heating in a substantially water free state in order to provide high-density color images in a short period of time. The images formed have a decreased amount of fogging and higher density as compared with conventional materials. Further, the disclosed material has excellent stability when stored.

6 Claims, No Drawings

HEAT DEVELOPABLE COLOR LIGHT-SENSITIVE MATERIALS WITH BASE RELEASORS

FIELD OF THE INVENTION

This invention relates to a heat developable color light-sensitive material, and more particularly to a novel light-sensitive material containing a dye releasing material capable of releasing a hydrophilic dye through a reaction with a light-sensitive silver halide by heating in a substantially water free state, and further containing a base precursor capable of releasing a basic component by thermal decomposition.

BACKGROUND OF THE INVENTION

Since a photographic process using silver halide is excellent in photographic properties such as sensitivity and gradation control as compared to other photographic processes, such as, for example, an electrophotographic process and a diazo photographic process, the silver halide photographic process has been most widely used. Recently, however, a technique capable of easily and rapidly obtaining images by employing a dry process such as heating, etc., as the image-forming process of a light-sensitive material using silver halide in place of a conventional wet process by a developing solution, etc., has been developed.

Heat developable light-sensitive materials are known in the field of the art and heat developable light-sensitive materials and processes for processing these light-sensitive materials are described in, for example, "Shashin Kogaku no Kisa (The Basis of Photographic Engineering)", pages 553–555, published by Corona K. K., 1979; "Eizo Joho (Image Information)", page 40, published April, 1978; "Nebletts Handbook of Photography and Reprography", 7th Ed, pages 32–33, published by Van Nostrand Reinhild Company; U.S. Pat. Nos. 3,152,904; 3,301,678; 3,392;020; 3,457,075; U.K. Pat. Nos. 1,131,108; 1,167,777; and "Research Disclosure", June 1978, pages 9–15 (RD-19029).

Various processes of obtaining color images by dry systems have been proposed. For example, for a process of forming color images by the combination of the oxidation product of a developing agent and couplers, there are provided p-phenylenediamine reducing agents and phenolic or active methylene couplers in U.S. Pat. No. 3,531,286; p-aminophenol reducing agents in U.S. Pat. No. 3,761,270; sulfonamidophenol reducing agents in Belgian Pat. No. 802,519 and "Research Disclosure", September 1975, pages 31 and 32; and the combination of sulfonamidophenol reducing agents and 4-equivalent couplers in U.S. Pat. No. 4,021,240.

Also, a process of introducing a nitrogen-containing heterocyclic group into a dye, forming a silver salt, and liberating the dye by heat development in the presence of the silver salt is described in "Research Disclosure", May 1978, pages 54–58 (RD-16966). However, in the process, clear images cannot be obtained since it is difficult to control the liberation of dye at unexposed areas and hence the process is unsuitable for general use.

Furthermore, for a process of forming positive color images by a heat-sensitive silver dye bleaching process, useful dyes and bleaching processes are described in, for example, "Research Disclosure", April 1976, pages 30–32 (RD-14433); ibid., December 1976, pages 14–15 (RD-15227); U.S. Pat. No. 4,235,957, etc.

However, the foregoing processes have the faults that an additional step of superposing an activating agent sheet followed by heating is required for accelerating the bleaching of the dye and also the color image formed is gradually bleached by reduction with existing free silver during the preservation of the color image for a long period of time.

Also, a process of producing color images utilizing leuco dyes is described in, for example, U.S. Pat. Nos. 3,985,565 and 4,022,617. However, the process has a fault that it is difficult to stably retain leuco dyes in light-sensitive materials and hence the light-sensitive material is gradually colored during the preservation thereof.

Furthermore, the foregoing various processes have the faults that a relatively long period of time is generally required for development and images obtained have high fog and low density.

SUMMARY OF THE INVENTION

An object of this invention is to overcome the faults in conventional materials as described above and to provide a novel color light-sensitive material forming dye images by heating in a substantially water free state.

Another object of this invention is to provide a light-sensitive material capable of providing a high-density color image in a short period of time.

Still another object of this invention is to provide a light-sensitive material capable of providing color images having less fog and high density.

Another object of this invention is to provide a thermally developable color light-sensitive material having excellent stability with the passage of time. By the term "stability with the passage of time" is meant that the hange in photographic properties such as the maximum density, the minimum density, the sensitivity, etc., is less during the preservation of the light-sensitive material before heat development.

The foregoing various objects of this invention can be attained by the present invention. That is, the invention is a heat developable color light-sensitive material comprising a support having thereon at least a light-sensitive silver halide, a binder, a dye-releasing material which is reductive to the light-sensitive silver halide and releases a hydrophilic dye by causing a reaction with the light-sensitive silver halide by heating, and a base precursor represented by the general formulae (A) and/or (B)

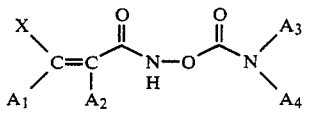

(A)

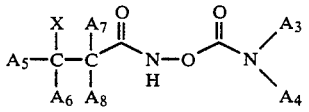

(B)

wherein $A_1$, $A_2$, $A_5$, $A_6$, $A_7$, and $A_8$ each represents a substituent selected from a hydrogen atom, an alkyl group which may be substituted, a cycloalkyl group, an alkenyl group, an aralkyl group, an aryl group which may be substituted, an acyl group, and a heterocyclic ring group; said $A_1$ and $A_2$ may combine with each other to form a ring and also two of said $A_5$, $A_6$, $A_7$, and $A_8$ may combine with each other to form a ring; $A_3$ and $A_4$ each represents a hydrogen atom, an alkyl group, a substituted alkyl group, a cycloalkyl group, or an aralkyl group; said $A_3$ and $A_4$ may combine with each other to form a ring; said

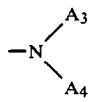

may become a double bond to form an imino group; and X represents a nucleuophilic group.

DESCRIPTION OF THE PREFERRED EMBODIMENT

Examples of the alkyl group shown by $A_1$ to $A_8$ of foregoing general formulae (A) and (B) are straight chain or branched alkyl groups having 1 to 22 carbon atoms, preferably 1 to 18 carbon atoms, which may be substituted with a hydroxy group, an alkoxy group, a cyano group, a carboxy group, a carboalkoxy group, a carbamoyl group, a halogen atom, etc.

Examples of the cycloalkyl group shown by $A_1$ to $A_8$ are 5- or 6-membered cycloalkyl groups having 5 to 22 carbon atoms, preferably 6 to 10 carbon atoms.

Examples of the alkenyl group shown by $A_1$, $A_2$, $A_5$, $A_6$, $A_7$ and $A_8$ has 2 to 22 carbon atoms, such as an allyl group, a crotyl group, a cinnamyl group, etc.

Examples of the aralkyl group shown by $A_1$ to $A_8$ are those having the alkyl moiety of 1 to 4 carbon atoms and the aryl moiety of 6 to 22 carbon atoms, such as a benzyl group, a $\beta$-phenetyl group, a benzhydrin group, etc.

Examples of the aryl group shown by $A_1$, $A_2$, $A_5$, $A_6$, $A_7$ and $A_8$ include a phenyl group, a naphthyl group, an anthryl group, etc., and the aryl group may be substituted with an alkyl group, an alkoxy group, a dialkylamino group, a cyano group, a nitro group, a halogen atom, etc.

Examples of the acyl group shown by $A_1$, $A_2$, $A_5$, $A_6$, $A_7$ and $A_8$ are those having 2 to 18 carbon atoms, which are induced from aliphatic or aromatic carboxylic acids.

Examples of the heterocyclic ring group shown by $A_1$, $A_2$, $A_5$, $A_6$, $A_7$ and $A_8$ are a pyridyl group, a furyl group, a thienyl group, a pyrrole group, an indolyl group, etc.

Examples of the ring formed by the combination of the foregoing $A_1$ and $A_2$ include an aromatic ring having 6 to 22 carbon atoms and a heterocyclic ring, and examples of the ring formed by two of $A_5$, $A_6$, $A_7$ and $A_8$ are cycloaliphatic rings, etc.

Examples of the ring formed by the combination of the foregoing $A_3$ and $A_4$ are

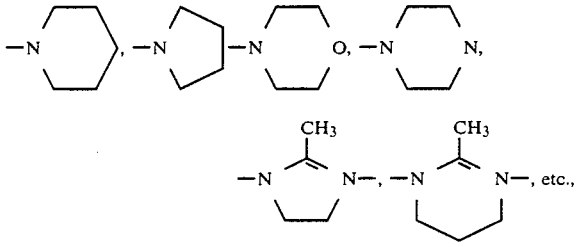

and also examples of the imino group formed by

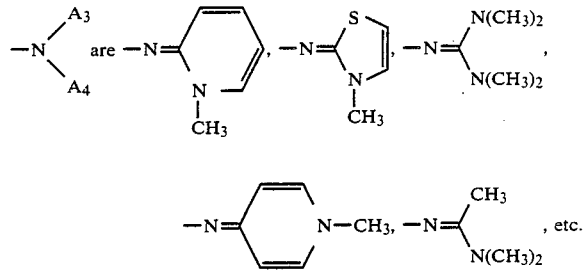

Examples of the nucleophilic group shown by X are a hydroxy group, a hydroxymethyl group, an amino group, a substituted amino group, an aminomethyl group, a substituted aminomethyl group, a mercapto group, a mercaptomethyl group, a carboxy group, a carbamoyl group, a substituted carbamoyl group, a sulfamoyl group, a substituted sulfamoyl group, etc.

Among the base percursors shown by the foregoing general formulae, the compounds of general formula (A) are preferred and the compounds of general formula (A) wherein $A_1$ and $A_2$ forms an aromatic ring or a heterocyclic ring are more preferred in this invention. The most preferred base precursor in this invention is the salicylhydroxamic acid carbamate derivative shown by the general formula (C)

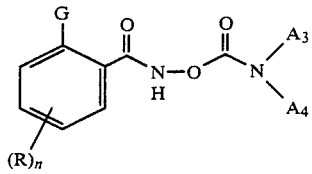

(C)

wherein R represents a substituent selected from an alkyl group, a substituted alkyl group, a cycloalkyl group, an alkenyl group, an aralkyl group, an aryl group, an alkoxy group, a substituted alkoxy group, an amino group, a substituted amino group, an acylamino group, a sulfonylamino group, an acyl group, a nitro group, a cyano group, a halogen atom, an aryloxy group, a carbamoyl group, a substituted carbamoyl group, a sulfamoyl group, and a substituted sulfamoyl group; $R_3$ and $R_4$ are as defined above; G is a nucleophilic group; and n is an integer of 0 to 4; when n is larger than 2, said R may be the same or different.

Practical examples of the alkyl, substituted alkyl, cycloalkyl, alkenyl, aralkyl, aryl and acyl groups shown by R of aforesaid general formula (C) are the same as those described in regard to $A_1$ to $A_8$. Examples of the alkoxy, acylamino and sulfonylamino group are those having 1 to 22 carbon atoms, and examples of the aryloxy group are those having 6 to 22 carbon atoms. Preferred examples of the nucleophilic group shown by G include —NHR', —OH, —SH and —COOH wherein R' represents a hydrogen atom or an alkyl group of 1 to 6 carbon atoms.

Preferred examples of the base precursors of this invention are illustrated as follows:

(1)
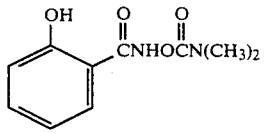
(2)
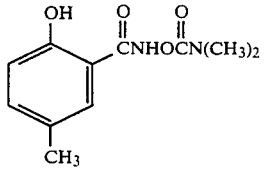
(3)
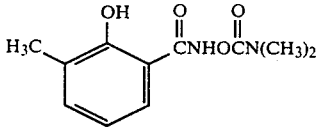
(4)
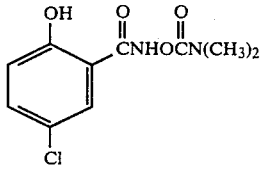
(5)
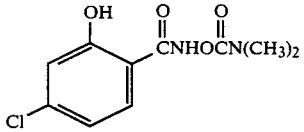
(6)
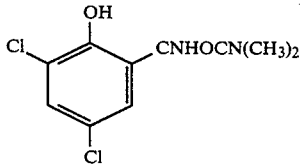
(7)
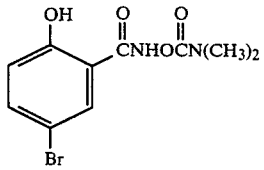
(8)
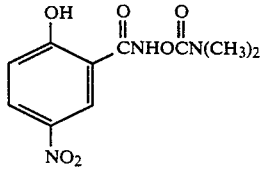
(9)
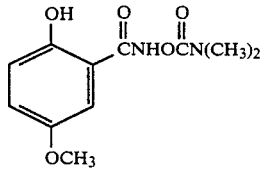
(10)
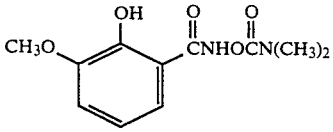
-continued
(11)
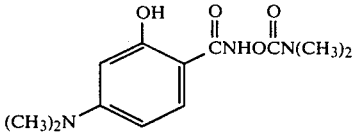
(12)
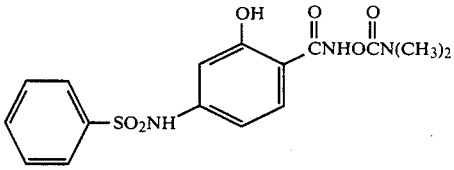
(13)
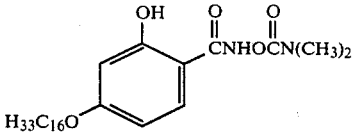
(14)
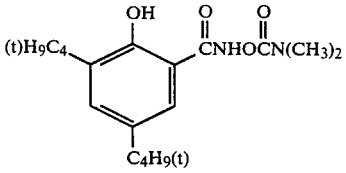
(15)
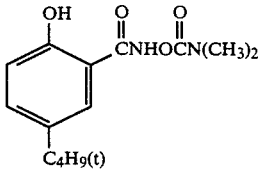
(16)
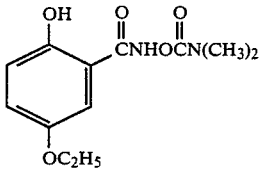
(17)
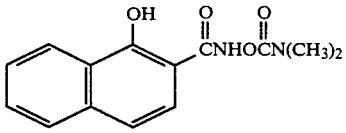
(18)
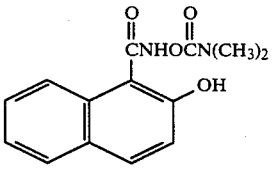
(19)
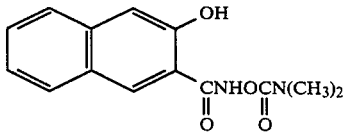
(20)
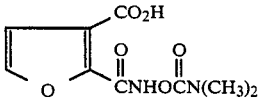

-continued
(21)
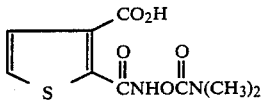
(22)
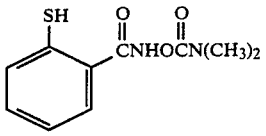
(23)
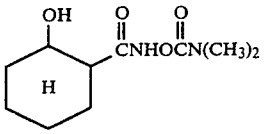
(24)
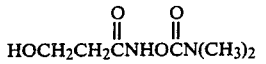
(25)
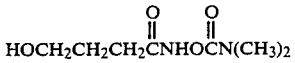
(26)
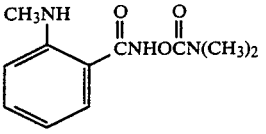
(27)
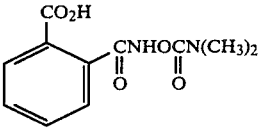
(28)
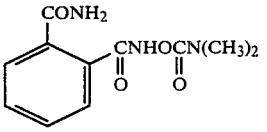
(29)
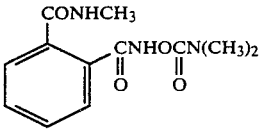
(30)
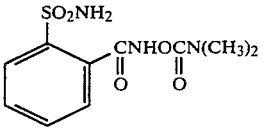
(31)
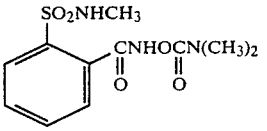
(32)
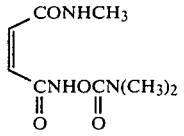
-continued
(33)
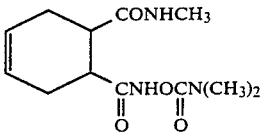
(34)
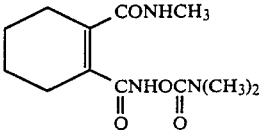
(35)
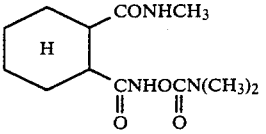
(36)
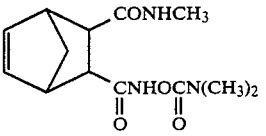
(37)
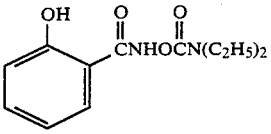
(38)
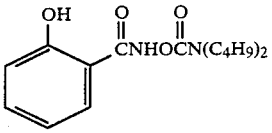
(39)
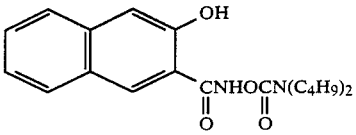
(40)
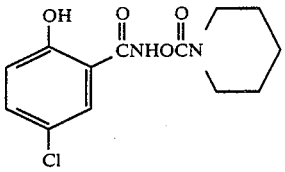
(41)
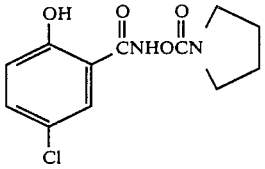
(42)
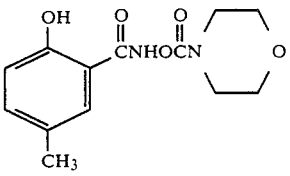

-continued

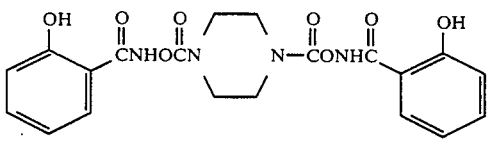

(43)

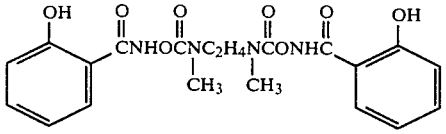

(44)

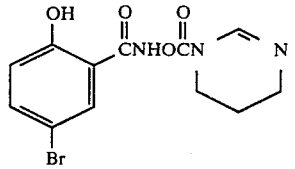

(45)

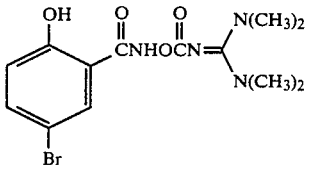

(46)

$HOCH_2CH_2CH_2CONHOCON(CH_3)_2$ (47)

$CH_3N(H)C(=O)CH_2CH_2CONHOCON(CH_3)_2$ (48)

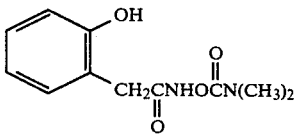

(49)

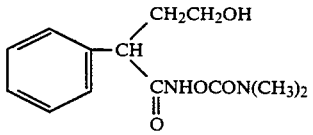

(50)

Synthesis examples of the base precursors of this invention are shown below.

Synthesis example (1): Synthesis of salicylhydroxamic acid N,N-dimethylcarbamate (1):

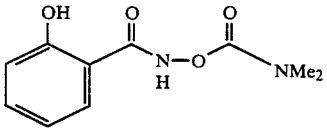

To a solution of 15.3 g of salicylhydroamic acid and 10 ml of N,N-dimethylcarbonyl chloride in dimethylformamide was added gradually 14 ml of triethylamine at room temperature and the mixture was stirred for 10 hours. The reaction mixture was poured in weak acid ice water and precipitates thus formed were collected by filtration and dried to provide 18 g of the desired product having a melting point of 95°-98° C. (dec.).

Synthesis example (2): Synthesis of 5-bromosalicylhydroxamic acid N,N-dimethylcarbamate (7):

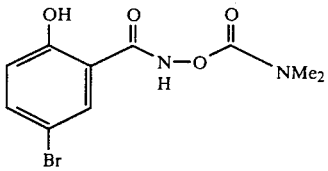

(2)-1: Preparation of phenyl 5-bromosalicylate:

To a suspension of 217 g of 5-bromosalicylic acid and 113 g of phenol in benzene was gradually added 80 ml of thionyl chloride and the mixture was refluxed for 10 hours. After distilling off benzene from the reaction mixture, ice-water was added to the residue and the precipitates thus formed were collected by filtration and dried to provide 210 g of the desired product.

(2)-2: Preparation of 5-bromosalicylhydroxamic acid:

To a methanol solution of 210 g of phenyl 5-bromosalycilate prepared in foregoing step (2)-1 and 105 g of hydroxylamine hydrochloride was gradually added a methanol solution of 127 g of potassium hydrochloride and after stirring the mixture for 4 hours, the precipitates thus formed were collected by filtration. The precipitates were suspended in water, 60 ml of concentrated hydrochloric acid was added to the suspension, and after stirring the mixture for 2 hours, the precipitates thus formed were collected by filtration and dried to provide 136 g of the desired product.

(2)-3: Preparation of 5-bromosalicylhydroxamic acid N,N-dimethylcarbamate:

To a dimethylformamide solution of 136 g of 5-bromosalicylhydroxamic acid prepared in foregoing step (2)-2 and 54 ml of N,N-dimethylcarbonyl chloride was gradually added 81 ml of triethylamine at room temperature followed by stirring for 10 hours. The reaction mixture was poured in ice-water and the precipitates thus formed were collected by filtration and dried to provide 102 g of the desired product having a melting point of 118°-119° C. (dec.).

Synthesis example (3): Synthesis of salicylhydroxamic acid N,N-dibutylcarbamate (38):

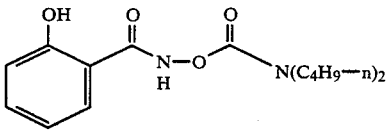

(3)-1: Preparation of N,N-dibutylcarbonyl chloride:

To a dichloromethane solution of 20 g of phosgene cooled to −40° C. was gradually added 8.4 g of dibutylamine and then excessive phosgene and dichloromethane were distilled off under reduced pressure at room temperature. The residue was extracted with water-hexane, the extract thus formed was dried, and hexane was distilled off from the extract to provide 7.5 g of the desired product.

(3)-2: Preparation of salicylhydroxamic acid N,N-dibutylcarbamate:

The same procedure as in Synthesis example (1) was followed using 6.0 g of salicylhydroxamic acid, 7.5 g of N,N-dibutylcarbonyl chloride prepared in foregoing step (2)-1, and 5.4 ml of trimethylamine. The reaction mixture was poured in ice-water and extracted with ethyl acetate. The filtrate was dried and then purified by column chromatography to provide 11.2 g of the desired product (oily product).

The base precursor in this invention can be used over a wide range of addition amounts. For example, it is advantageous that the base precursor be used in a coverage of 50 to 0.01% by weight, preferably 30 to 0.01% by weight based on the total amount of coatings (dry basis) provided on the support base. The base precursor may be incorporated in a dye-fixing layer as described later.

The base precursors in this invention may be used solely or as a mixture of two or more kinds of the precursors or may be used as a combination of other known bases or base precursors.

Examples of such bases are amines which include trialkylamines, hydroxylamines, aliphatic polyamines, N-alkyl substituted aromatic amines, N-hydroxyalkyl substituted aromatic amines and bis[p-(dialkylamino)-phenyl]methanes. Further, betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444 are useful. Examples of typical base precursors are described in British Pat. No. 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used becuase they decompose at a high temperature to form bases.

The heat developable color light-sensitive material of this invention can simultaneously provide a silver image and a mobile dye or mobile dyes at an area corresponding to the silver image by only heating the color light-sensitive material in a substantially water-free state after image exposure (this is called "heat development").

When the heat developable color light-sensitive material of this invention is image-exposed and developed by heating in a substantially water-free state, an oxidation reduction reaction occurs between the light-sensitive silver halide and the reducing dye-releasing material with the exposed light-sensitive silver halide to form a silver image at the exposed area. In this step the dye-releasing material is oxidized by the light-sensitive silver halide to form the oxidation product thereof, whereby a hydrophilic mobile dye is released and a silver image and the mobile dye are obtained at the exposed area. In this case, when a base exists in the system, the foregoing reaction is accelerated. By transferring the mobile dye or dyes onto a dye-fixing layer, a dye image is obtained. However, if a base is directly incorporated in a color light-sensitive material, the stability of the light-sensitive material with the passage of time is reduced. On the other hand, in the case of using the base precursor of this invention, a base is released when developing the light-sensitive material containing the base precursor by heating at high temperature. Accordingly, the stability of the light-sensitive material with the passage of time can be improved.

The foregoing explantation relates to using a negative-type silver halide emulsion. An explanation on using an autopositive silver halide emulsion is same that a silver image and the mobile dye are obtained at the unexposed area.

It is a feature of this invention that the oxidation reduction reaction of the light-sensitive silver halide and the dye-releasing material and the subsequent dye-releasing reaction occur at high temperature in a substantially water free state. The "high temperature" in this invention is a temperature condition of higher than 80° C. and the "substantially water free state" is that state that the state is in an equilibrium relation with the moisture in the air but water is not supplied from outside the system. Such a state is described in "The Theory of the Photographic Process", 4th Ed., page 374, Edited by T. H. James, published by Macmillan Co.

The system of this invention shows a sufficient reactivity even in the substantially water free state and this can be confirmed from the fact that when a sample is dried in vacuum of $10^{-3}$ Hg for one day, the reactivity thereof is not reduced.

Hitherto, it has been considered that a dye-releasing reaction is caused by the attach of a so-called nucleophilic reagent and the dye-releasing reaction is usually performed in a liquid with a pH of higher than 10. Therefore, it is beyond expectation that the heat developable color light-sensitive material shows a high reactivity under high temperature in a substantially water free dry state. Also, the dye-releasing material of this invention can cause an oxidation reduction reaction with silver halide without requiring the assistance of a so-called auxiliary developing agent. This is also unexpected from conventional knowledge about wet development at temperatures near normal temperature.

When an organic silver salt oxidizing agent exists in the reaction system, the foregoing reaction proceeds well and gives a high image density. Accordingly, it is a particularly preferred embodiment in this invention that an organic silver salt oxidizing agent exists in the reaction system.

The dye-releasing redox compound which releases a hydrophilic diffusible dye used in the present invention is a compound described in European Patent Application (OPI) No. 76,492 as a dye-releasing compound and is represented by the following general formula:

$$R_a—SO_2—D$$

wherein $R_a$ represents a reducing group capable of being oxidized by the silver halide; and D represents an image forming dye portion containing a hydrophilic group.

The above-described compound is oxidized corresponding to or reversely corresponding to latent image distributed imagewise in the silver halide and releases imagewise a mobile dye.

The detail definitions of $R_a$ and D, examples of the specific compounds and synthesis examples thereof are described in European Patent Application (OPI) No. 76,492.

As the dye-releasing redox compounds used in the present invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published patent application B 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120, etc., are also effective in addition to the above-described compounds.

Further, the dye-releasing redox compounds which release a yellow dye as described, for example, in U.S. Pat. Nos. 4,013,633, 4,156,609, 4,148,641, 4,165,987, 4,148,643, 4,183,755, 4,246,414, 4,268,625 and 4,245,028, Japanese Patent Application (OPI) Nos. 71072/81, 25737/81, 138744/80, 134849/80, 106727/77, 114930/76, etc., can be effectively used in the present invention.

The dye-releasing redox compounds which release a magenta dye as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in the present invention.

The dye-releasing redox compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., can be effectively used in the present invention.

Two or more of the dye-releasing redox compounds can be used together. In these cases, two or more dye-releasing redox compounds may be used together in order to represent the same color or in order to represent black color.

The dye-releasing redox compounds are suitably used in a range from 10 mg/m$^2$ to 15 g/m$^2$ and preferably in a range from 20 mg/m$^2$ to 10 g/m$^2$ in total.

The dye-releasing redox compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye-releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above-described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye-releasing redox compound is dispersed in a hydrophilic colloid. For this purpose, the surface active agents illustrated in other part of the specification can be used.

In the present invention, if necessary, a reducing agent may be used. The reducing agent in this case is the so-called auxiliary developing agent, which is oxidized by the silver halide and/or the organic silver salt oxidizing agent to form its oxidized product having an ability to oxidize the reducing group $R_a$ in the dye-releasing redox compound.

Examples of useful auxiliary developing agents include the compounds specifically described in European Patent Application (OPI) No. 76,492.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its grain. That is, the silver halide the X-ray diffraction diffraction pattern of pure silver iodide is particularly preferred.

In photographic materials a silver halide containing two or more kinds of halogen atoms can be used. Such a silver halide is present in the form of mixed crystal in a conventional silver halide emulsion. For example, the grain of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its grain and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 $\mu$m to 10 $\mu$m and more preferably from 0.001 $\mu$m to 5 $\mu$m.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide etc., or a combination thereof. The details thereof are described in T. H. James, *The Theory of the photographic Process,* the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the dye-releasing redox compound or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher cooler density can be obtained.

The silver halide used in the case need not necessarily contain pure silver iodide crystals, and any silver halide which is known in the art can be used.

Examples of such organic silver salt oxidizing agents include those described in European Patent Application (OPI) No. 76,492.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as silver salt of methylbenzotriazole, etc., a silver salt of a halogen substituted benzotriazole such as a silver salt of 5-chlorobenzotraizole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The light-sensitive silver halide and the organic silver salt oxidizing agent used in the present invention are prepared in the binder as described below. Further, the dye-releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, etc., a cellulose derivative, a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, can be contained in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

As nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used in merocyanine dyes and complex merocyanine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or with materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. Nos. 3,743,510), cadmium salts, azaindene compounds, etc., can be present. The combinations described in U.S. Pat. Nos. 3,615,613, 3,615,641, 3,617,295 and 3,635,721 are particularly useful.

Support used in the light-sensitive material and a dye-fixing material described later, should be capable of enduring the processing temperatures. The support may be not only glass, paper, metal or analogues thereto, but also an acetyl cellulose film, a cellulose ester film, a polyvinyl acetal film, a polystyrene film, a polycarbonate film, a polyethylene terephthalate film, and a film related thereto or a plastic material. Further, a paper support laminated with a polymer such as polyethylene, etc., can be used. The polyesters described in U.S. Pat. Nos. 3,634,089 and 3,725,070 are preferably used.

It is advantageous to use a compound represented by the general formula described below in the heat-developable color light-sensitive material in order to accelerate development and accelerate release of a dye.

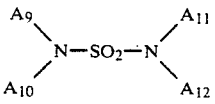

(D)

wherein $A_9$, $A_{10}$, $A_{11}$ and $A_{12}$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_9$ and $A_{10}$ or $A_{11}$ and $A_{12}$ may combine with each other to form a ring.

The above-described compound can be used in an amount over a broad range. A useful range is up to 20% by weight based on the total amount of coatings (dry basis) provided on the support base. A range of 0.1% by weight to 15% by weight is more preferred.

It is advantageous to use a water releasing compound in the present invention in order to accelerate the dye-releasing reaction.

The water-releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the present invention, it is possible to use a compound which activates development and stabilized the image at the same time. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis-(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, it is possible to use a thermal solvent. The term "thermal solvent" means a non-hydrolyzable organic material which melts at a temperature of heat treatment and melts at a lower temperature of heat treatment when it is present together with other components. Preferred examples of thermal solvents include compounds which can act as a solvent for the developing agent and compounds having a high dielectric constant which accelerate physical development of silver salts. Examples of preferred thermal solvents include those described in European Patent Application (OPI) No. 76,492.

In the present invention, though it is not always necessary to further incorporate substances or dyes for preventing irradiation or halation in the light-sensitive material, because the light-sensitive material is colored by the dye-releasing redox compound, it is possible to add filter dyes or light absorbing materials, etc. into the light-sensitive material, as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

The light-sensitive layer and other hydrophilic colloid layers in the light-sensitive material of the present invention may contain various surface active agents for various purposes, for example, as coating aids or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate salts, alkylbenzenesulfonate salts, alkylnaphthalenesulfonate salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamines salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic solfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series, Vol.* 1, *Nonionic Surfactants* (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in *PSA Journal,* Section B 36 (1953), U.S. Pat. Nos. 2,648,604 and 3,671,247, Japanese Patent Publication Nos. 30074/69 and 9503/69, etc.

In the light-sensitive material of the present invention and a dye-fixing material described later, the light-sensitive layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds, (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agent, etc.

If necessary, two or more layers may be applied at the same time by the method as described in U.S. Pat. No. 2,761,791 and British Pat. No. 837,095.

Various means of exposure can be used in the present invention. Latent images are obtained by image-wise exposure by radiant rays including visible rays. Generally, light sources used in the present invention include tungsten lamps, mercury lamps, halogen lamps such as iodine lamps, xenon lamps, laser light sources, CRT light sources, fluorescent tubes and light-emitting diodes, etc.

In the present invention, after the heat-developable color light-sensitive material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful.

As the heating means, a simple heat plate, iron, heat roller, heat generator utilizing carbon or titanium white, etc., or analogous thereto may be used.

In the present invention, a method for forming a color image by heat development comprises transfer of a hydrophilic mobile dye. For this purpose, the heat-developable color light-sensitive material of the present invention may have on the light-sensitive layer, a dye-fixing layer capable of receiving the hydrophilic diffusible dye formed in the light-sensitive layer.

The above described light-sensitive layer and the dye-fixing layer may be formed on the same support, or they may be formed on different supports, respectively. The dye fixing layer can be stripped off the light-sensitive layer. For example, after the heat-developable color light-sensitive material is exposed imagewise to light, it is developed by heating uniformly and thereafter the dye fixing layer or the light-sensitive layer is peeled apart. Also, when a light-sensitive material having the light-sensitive layer coated on a support and a dye-fixing material having the dye-fixing layer coated on a support are separately formed, after the light-sensitive material is exposed imagewise to light and uniformly heated, the mobile dye can be transferred on the dye-fixing layer by superposing the dye-fixing material on the light-sensitive layer.

Further, there is a method wherein only the light-sensitive layer is exposed imagewise to light and then heated uniformly by superposing the dye-fixing layer on the light-sensitive layer.

The dye-fixing layer can contain, for example, a dye mordant in order to fix the dye. In the present invention, various mordants can be used, and polymer mordants are particularly preferred. In addition to the mordants, the dye-fixing layer may contain the bases, base precursors and thermal solvents. In particular, it is particularly preferred to incorporate the bases or base precursors into the dye-fixing layer in the cases wherein the light-sensitive layer and the dye-fixing layer are formed on different supports.

Preferred polymer mordants used in the dye-fixing layer are polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc. can be illustrated.

In addition, mordants disclosed in U.S. Pat. Nos. 2,675,316 and 2,882,156 can be used.

The dye-fixing material can have a white reflective layer. For example, a layer of titanium dioxide dispersed in gelatin can be provided on the mordant layer on a transparent support. The layer of titanium dioxide forms a white opaque layer, by which reflection color images of the transferred color images which is observed through the transparent support is obtained.

Typical dye-fixing material used in the present invention is obtained by mixing the polymer containing ammonium salt groups with gelatin and applying the mixture to a transparent support.

The transfer of dyes from the light-sensitive layer to the dye-fixing layer can also be carried out using a dye transfer assistant. Examples of useful dye transfer assistant include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant can be employed by wetting the dye-fixing layer with the transfer assistant or by incorporating it in the form of water of crystallization or microcapsules into the material.

EXAMPLE 1

In 3,000 ml of water were dissolved 40 g of gelatin and 26 g of potassium bromide and the solution was stirred at 50° C. Then, a solution of 34 g of silver nitrate in 200 ml of water was added to the foregoing solution over a period of 10 minutes and thereafter a solution of 3.3 g of potassium iodide in 100 ml of water was added thereto over a period of 2 minutes.

The pH of the silver iodobromide emulsion was controlled to precipitate excessive salts, which were removed. Thereafter, the pH of the emulsion was adjusted to 6.0 to provide 400 g of a silver iodobromide emulsion.

Then, a gelatin dispersion of a dye-releasing material was prepared as follows.

To 30 ml of ethyl acetate were added 5 g of dye-releasing material (1) shown below, 0.5 g of a surface active agent, succinic acid-2-ethyl-hexyl ester sodium sulfonate, and 5 g of tricresyl phosphate and the mixture was heated to about 60° C. to form a solution. The solution was mixed with 100 g of an aqueous 10% gelatin solution with stirring and the resultant mixture was treated in a homogenizer at 10,000 r.p.m. for 10 minutes to form a dispersion. The dispersion is called a dispersion of dye-releasing material. Dye-releasing material (1)

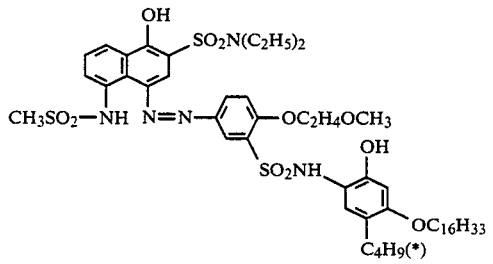

Then, a light-sensitive coated material was prepared as follows.

| | | |
|---|---|---|
| (a) | The foregoing photosensitive silver iodobromide emulsion | 25 g |
| (b) | The dispersion of dye-releasing material | 33 g |
| (c) | Aqueous 5% solution of the following compound | 10 ml |

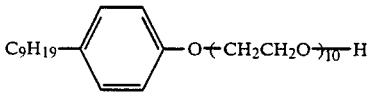

-continued

| | | |
|---|---|---|
| (d) | Aqueous 10% solution of the following compound $H_2NSO_2N(CH_3)_2$ | 4 ml |
| (e) | Solution of 2 g of base precursor (1) of this invention in 20 ml of ethanol | |

A mixture of the foregoing components (a) to (e) was heated at 40° C. to form a solution and the solution was coated on a polyethylene terephthalate film of 180 μm in thickness at a wet thickness of 30 μm to provide a light-sensitive coated material.

After drying, the coated sample was imagewise exposed to a tungsten lamp at 2,000 lux for 10 seconds and thereafter, the sample was uniformly heated on a heat block heated to 140° C. for 60 seconds to provide sample A.

Then, by following the same procedure as when preparing sample A except that 4 ml of water was used in place of the compound (e) of this invention, sample B was prepared.

Then, an dye-fixing material having a dye-fixing layer was prepared as follows.

In 200 ml of water was dissolved 10 g of poly(methylacrylate-co-N,N,N-trimethyl-N-vinylbenzylammonium chloride) (the ratio of methyl acrylate and vinylbenzylammonium chloride was 1:1) and the solution was uniformly mixed with 100 g of an aqueous 10% solution of limed gelatin. The mixture was uniformly coated on a paper support having laminated thereon a layer of polyethylene having dispersed therein titanium dioxide at a wet thickness of 90 μm and dried to provide an dye-fixing material.

After wetting the dye-fixing material with water, each of the foregoing heated light-sensitive materials A and B was superposed on the dye-fixing material so that the coated layers were in a face-to-face relationship.

After heating the assembly on a heat block heated to 80° C. for 6 seconds, the dye-fixing material was separated from the light-sensitive material, a negative magenta dye image was obtained on the dye-fixing material. When the density of the negative image was measured using a Macbeth reflection densitometer (RD-519), the following results were obtained.

| Sample No. | Maximum density | Minimum density |
|---|---|---|
| A | 2.20 | 0.20 |
| B (comparison) | 0.03 | 0.30 |

From the above results, it is understood that the base precursor of this invention gives high density.

Furthermore, when sample A was preserved for 2 days at 60° C. and then processes by the same manner as above, the minimum density and the maximum density were 0.25 and 2.15 respectively, which indicates that the sample of this invention is also excellent in shelf life.

EXAMPLE 2

By following the same procedure as in Example 1 except that the base precursors shown in the following table were used in the amounts shown in the same table, the following results were obtained.

| Sample No. | Base precursor | Maximum density |
|---|---|---|
| C | Compound (2) 2.0 g | 1.90 |

-continued

| Sample No. | Base precursor | Maximum density |
|---|---|---|
| D | Compound (3) 2.0 g | 1.92 |
| E | Compound (10) 2.5 g | 1.88 |
| F | Compound (15) 3.0 g | 1.94 |
| G | Compound (16) 3.0 g | 1.85 |
| H | Compound (37) 4.0 g | 1.62 |
| I | Compound (38) 4.5 g | 1.45 |
| J | Compound (39) 4.5 g | 1.41 |

From the above results, it is understood that the base precursors of this invention have excellent effects.

EXAMPLE 3

By following the same procedure as in Example 1 except that each of the following dye-releasing materials was used in place of the dye-releasing material (1) in Example 1, the following dispersions of dye-releasing materials were prepared.

| | | |
|---|---|---|
| Dye-releasing material (2) | 5 g | Dispersion (I) |
| Dye-releasing material (3) | 7.5 g | Dispersion (II) |
| Dye-releasing material (4) | 5 g | Dispersion (III) |

Dye-releasing material (2)

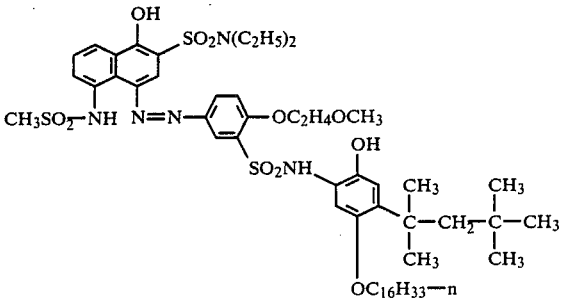

Dye-releasing material (3)

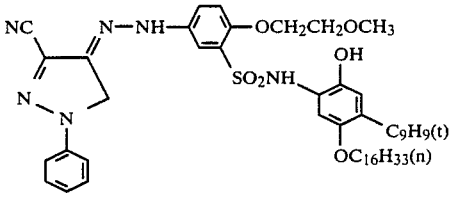

Dye-releasing material (4)

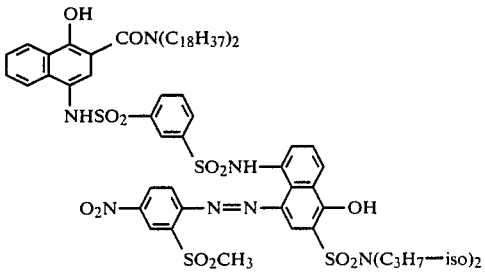

Also, by following the same procedure as in Example 1, light-sensitive samples were prepared and they were processed as in Example 1. The results obtained are shown in the following table.

| Dispersion of dye-releasing material | Base precursor (1) of this invention | Maximum density | Minimum density |
|---|---|---|---|
| Dispersion (I) | used | 2.30 | 0.18 |
| (magenta) | none | 1.85 | 0.03 |
| Dispersion (II) | used | 1.85 | 0.20 |
| (yellow) | none | 0.03 | 0.03 |
| Dispersion (III) | used | 2.35 | 0.44 |
| (cyan) | none | 0.20 | 0.05 |

From the above results, it is understood that the base precursors of this invention provide images with high maximum density.

EXAMPLE 4

An example using an organic silver salt oxidizing agent is shown below.

Preparation of a benzotriazole silver salt emulsion:

In 3,000 ml of water were dissolved 28 g of gelatin and 13.2 g of benztriazole and the solution was stirred at 40° C. To the solution was added a solution of 17 g of silver nitrate in 100 ml of water over a period of two minutes.

The pH of the benzotriazole silver salt emulsion was controlled to precipitate excessive salts, which were then removed. Thereafter, the pH of the emulsion was adjusted to 6.0 to provide 400 g of a benzotriazole silver salt emulsion.

A light-sensitive coated material was prepared as follows using the benzotriazole silver salt emulsion.

| | | |
|---|---|---|
| (a) | Silver iodobromide emulsion (as described in Example 1) | 20 g |
| (b) | Benzotriazole silver salt emulsion | 10 g |
| (c) | Dispersion of Dye-releasing material (1) | 33 g |
| (d) | Aqueous 5% solution of the following compound | 10 ml |

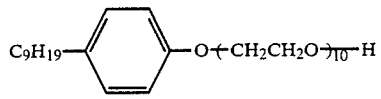

| | | |
|---|---|---|
| (e) | Aqueous 10% solution of the following compound $H_2NSO_2N(CH_3)_2$ | 4 ml |
| (f) | Solution of 2.5 g of base precursor (1) of this invention in 25 ml of ethanol | 2.5 g |

Foregoing components (a) to (e) were mixed and by following the same procedure as in Example 1 using the mixture, a light-sensitive sample was prepared. The sample was processed as in Example 1. The results obtained are shown below together with the results of a comparison sample prepared by the same method as above without using the base precursor.

| Sample | Maximum density | Minimum density |
|---|---|---|
| Sample of this invention (containing the base precursor of this invention) | 2.38 | 0.21 |
| Comparison sample using no base precursor | 0.03 | 0.03 |

From the above results, it is understood that the base precursor of this invention provides images with high density.

While the invention has been described in detail and with reference to specific embodiments thereof, it will be apparent to one skilled in the art that various changes and modifications can be made therein without departing from the spirit and scope thereof.

What is claimed is:

1. A heat developable color light-sensitive material, comprising:

a support base having thereon;

a light-sensitive silver halide;

a binder;

a dye-releasing material which is reductive to the light-sensitive silver halide and releases a hydrophilic dye by causing a reaction with the light-sensitive silver halide by heating; and a base precursor represented by a general formula selected from the group consisting of the general formulae (A) and (B):

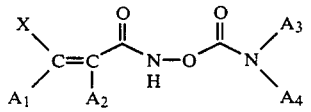

(A)

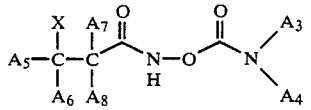

(B)

wherein $A_1$, $A_2$, $A_5$, $A_6$, $A_7$, and $A_8$ independently represent a substituent selected from a hydrogen atom, an alkyl group, a substituted alkyl group, a cycloalkyl group, an alkenyl group, an aralkyl group, an aryl group, a substituted aryl group, an acyl group, and a heterocyclic group, $A_1$ and $A_2$ may combine each other to form a ring, two of $A_5$, $A_6$, $A_7$ and $A_8$ may combine with each other to form a ring, and $A_3$ and $A_4$ each represents a hydrogen atom, an alkyl group, a substituted alkyl group, a cycloalkyl group, or an aralkyl group, $A_3$ and $A_4$ may combine with each other to form a ring and

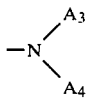

may become a double bond to form an imino group and X represents a nucleophilic group.

2. A material as claimed in claim 1, wherein the base precursor is a compound represented by the general formula (A).

3. A material as claimed in claim 2, wherein $A_1$ and $A_2$ form an aromatic ring or a heterocyclic ring.

4. A material as claimed in claim 1, wherein the base precursor is a compound represented by the general formula (C):

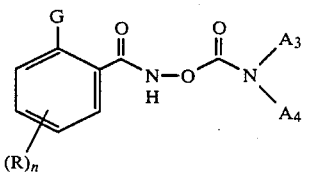

(C)

wherein R is a substituent selected from an alkyl group, a substituted alkyl group, a cycloalkyl group, an alkenyl group, an aralkyl group, an aryl group, an alkoxy group, a substituted alkoxy group, an amino group, a substituted amino group, an acylamino group, a sulfonylamino group, an acyl group, a nitro group, a cyano group, a halogen atom, an aryloxy group, a carbamoyl group, a substituted carbamoyl group, a sulfamoyl group and a substituted sulfamoyl group, G is a nucleophilic group, and n is an integer of 0 to 4; when n is larger than 2, the R's may be the same or different, and $A_3$ and $A_4$ are as define in claim 1.

5. A material as claimed in claim 1, wherein X is a hydroxy group, a hydroxy methyl group, an amino group, a substituted amino group, an aminomethyl group, a substituted aminomethyl group, a mercapto group, a mercaptomethyl group, a carboxy group, a carbamoyl group, a substituted carbamoyl group, a sulfamoyl group, or a substituted sulfamoyl group.

6. A material as claimed in claim 4, wherein G represents —NMR', —OH, —SH or —COOH, and wherein R' represents a hydrogen atom or an alkyl group of 1 to 6 carbon atoms.

* * * * *